US006783408B2

(12) United States Patent
Uraki et al.

(10) Patent No.: US 6,783,408 B2
(45) Date of Patent: Aug. 31, 2004

(54) JET PROPULSION BOAT

(75) Inventors: Mamoru Uraki, Saitama (JP); Takao Kochi, Saitama (JP); Tomoya Kono, Saitama (JP); Hajime Shogase, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/351,519

(22) Filed: Jan. 27, 2003

(65) Prior Publication Data

US 2004/0014381 A1 Jan. 22, 2004

(30) Foreign Application Priority Data

Feb. 4, 2002 (JP) ..... 2002-027457

(51) Int. Cl.[7] ..... B63H 23/00
(52) U.S. Cl. ..... 440/1; 440/67
(58) Field of Search ..... 440/1, 40, 41, 440/42, 87

(56) References Cited

U.S. PATENT DOCUMENTS 6,159,059 A 12/2000 Bernier et al. ..... 440/40
6,551,152 B2 * 4/2003 Matsuda et al. ..... 440/1
6,568,968 B2 * 5/2003 Matsuda ..... 440/87
6,589,085 B2 * 7/2003 Matsuda et al. ..... 440/1
2001/0036777 A1 * 11/2001 Iida et al. ..... 440/84
2003/0064642 A1 * 4/2003 Funayose et al. ..... 440/84

* cited by examiner

*Primary Examiner*—Sherman Basinger
(74) *Attorney, Agent, or Firm*—Birch, Stewart, Kolasch & Birch, LLP

(57) ABSTRACT

A controller that executes engine output control that a throttle is closed when a boat is navigated at a predetermined speed or higher and the output of an engine is gradually increased up to predetermined output when a steering system is steered right or left at a predetermined angle or more is provided. Thus, an overshoot phenomenon that the engine speed is held at a predetermined engine speed after the engine speed once increases up to the predetermined engine speed or higher when the engine speed is increased in deceleration can be avoided. As a result, the body of the boat can be prevented from sliding laterally to a great extent at the beginning of turning and the turning performance of the body can be enhanced.

20 Claims, 7 Drawing Sheets

AUXILIARY PROPULSION GENERATED
THROTTLE ANGLE (θ)
θ2
P1
P2
TIME

RETARD AMOUNT
P3
P4
P5
P6
P7
P8
P9
P10
P11
P12
P13
P14
P15
TIME

ENGINE SPEED (Ne)
TIME 10A
10B
①
10C

JET PROPULSION BOAT

CROSS-REFERENCE TO RELATED APPLICATIONS

The present nonprovisional application claims priority under 35 USC 119 to Japanese Patent Application No. 2002-027457 filed on Feb. 4, 2002 the entire contents thereof is hereby incorporated by reference.

BACKGROUND OF THE INVENTION

1. Field of the Invention

The present invention relates to a jet propulsion boat of a type wherein a body of the boat is advanced by jetting a jet stream via a nozzle and the direction of the nozzle is changed by a steering system when the boat is turned right or left.

2. Description of Background Art

A jet propulsion boat acquires propulsion by jetting a jet stream and changes the direction of the body by changing the direction of the jet stream. Therefore, changing the direction of the boat is disabled without a jet stream.

Generally a human being, when he/she tries to avoid an obstacle for example, he/she is apt to reduce the speed of a boat and turn a steering handlebar to the right or left. The reduction in the speed means closing a throttle and as the output of an engine is small even if the steering handlebar is steered right or left in a state in which the throttle is closed, the jet stream is weak and the direction of the body cannot be changed as desired. This is more pronounced when the boat is particularly navigated at a high speed.

A technique for supplementing such a characteristic of the jet propulsion boat is disclosed in U.S. Pat. No. 6,159,059.

This technique enables a throttle regulator 46 to be prevented from being rapidly closed when a throttle lever 34 is released and a predetermined jet stream can be maintained for a while when the throttle lever 34 is returned by connecting one end of a throttle cable 44 to the throttle regulator 46, connecting the throttle lever 34 to the other end of the throttle cable 44, arranging a throttle return spring 49 for replacing the throttle lever 34 and arranging compressible material 52 at the base of the throttle lever 34 according to FIGS. 2 and 3 of U.S. Pat. No. 6,159,059.

However, after a while wherein the predetermined jet stream is maintained, an amount of the jet stream decreases and the turning performance is deteriorated. As a result, the operation of the boat is deteriorated.

FIGS. 7(*a*) to 7(*c*) are explanatory drawings showing an improved jet propulsion boat.

FIG. 7(*a*) is a graph showing a throttle angle under control, the y-axis shows a throttle angle θ and the x-axis shows time. FIG. 7(*b*) is a graph showing engine speed under control, the y-axis shows engine speed Ne and the x-axis shows time. FIG. 7(*c*) shows the movement of the jet propulsion boat 100 under control.

As shown in FIG. 7(*a*), a throttle is once turned off and after predetermined time (between P101 and P102) elapses, a throttle angle θ is set to θ3. That is, auxiliary propulsion is generated between P102 and P103.

As shown in FIG. 7(*b*), when the body of the boat 100A shown in FIG. 7(*c*) is propelled, pressure in front of an impeller (not shown) is lower than pressure at the back and when the speed of the boat 100A is reduced, pressure in front of the impeller is higher than pressure at the back. Therefore, when the engine speed is increased to enhance the output of an engine during the reduction of the speed of the boat, an overshoot phenomenon S wherein the engine speed is held at a predetermined engine speed after the engine speed once increases up to the predetermined engine speed or higher occurs.

As shown in FIG. 7(*c*), a jet propulsion boat 100A that is navigated in a straight line generates an auxiliary propulsion at the time of the jet propulsion boat 100B, the engine speed is increased due to the overshoot phenomenon S and the boat may slide laterally to a great extent in a direction shown by an arrow 2 to the jet propulsion boat 100C.

That is, a jet propulsion boat that can maintain a suitable jet stream to turn the boat is desired.

SUMMARY AND OBJECTS OF THE INVENTION

It is an object of the present invention to provide a jet propulsion boat that closes a throttle when the boat is navigated at a predetermined speed or higher for securing a fixed turning performance even if a steering handlebar is steered right or left at a predetermined angle or more, that is, during deceleration.

To achieve the object of the present invention a jet propulsion boat of a type wherein an impeller is turned by an engine as a driving source is provided wherein a jet stream is generated by the impeller. The boat is advanced by jetting the jet stream via a nozzle and the direction of the nozzle is changed by a steering system when the body of the boat is turned to the right or left. A controller is provided for executing engine output control wherein a throttle is closed when the boat is navigated at a predetermined speed or higher and the output of the engine is gradually increased up to a predetermined output when a steering handlebar is steered to the right or left at a predetermined angle or more is provided.

When the throttle is closed and the steering handlebar is steered to avoid an obstacle which emerges in front of the boat, turning performance is deteriorated because the amount of the jet stream decreases. Then, the output of the engine is increased up to a predetermined output and the amount of a jet stream is increased under a fixed condition.

However, when the throttle is closed and the output of the engine is reduced for navigation at a lower speed such as entering a port, the engine speed is not required to be increased. As turning performance is in question, the output of the engine is not required to be increased when the steering handlebar is not steered.

Therefore, it is a prerequisite that the throttle is closed when the boat is navigated at a predetermined speed or higher and the steering handlebar is steered right or left at a predetermined angle or more.

When the boat is propelled, pressure in front of the impeller is lower than pressure at the back and when the boat is decelerated, pressure in front of the impeller is higher than pressure at the back. Therefore, when the engine speed is increased to enhance the output of the engine during deceleration, an overshoot phenomenon wherein the engine speed is held at a predetermined engine speed after the engine speed once increases up to the predetermined engine speed or higher occurs and the body of the boat may slide laterally to a great extent. Then, the controller that executes an engine control for gradually increasing the output of the engine up to a predetermined output is provided. As a result, the body of the boat can be prevented from sliding laterally to a great extent at the beginning of the turning.

The present invention includes a controller that is provided with plural engine control characteristics and the output control of the engine is executed by selecting the speed of the boat.

The engine output control characteristic matched with the speed of the boat can be used by providing plural engine output control characteristics to the controller and enabling selection depending upon the speed of the boat.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Referring to the attached drawings, embodiments of the invention will be described below. The drawings shall be viewed in a direction of reference numbers.

Figure 1:
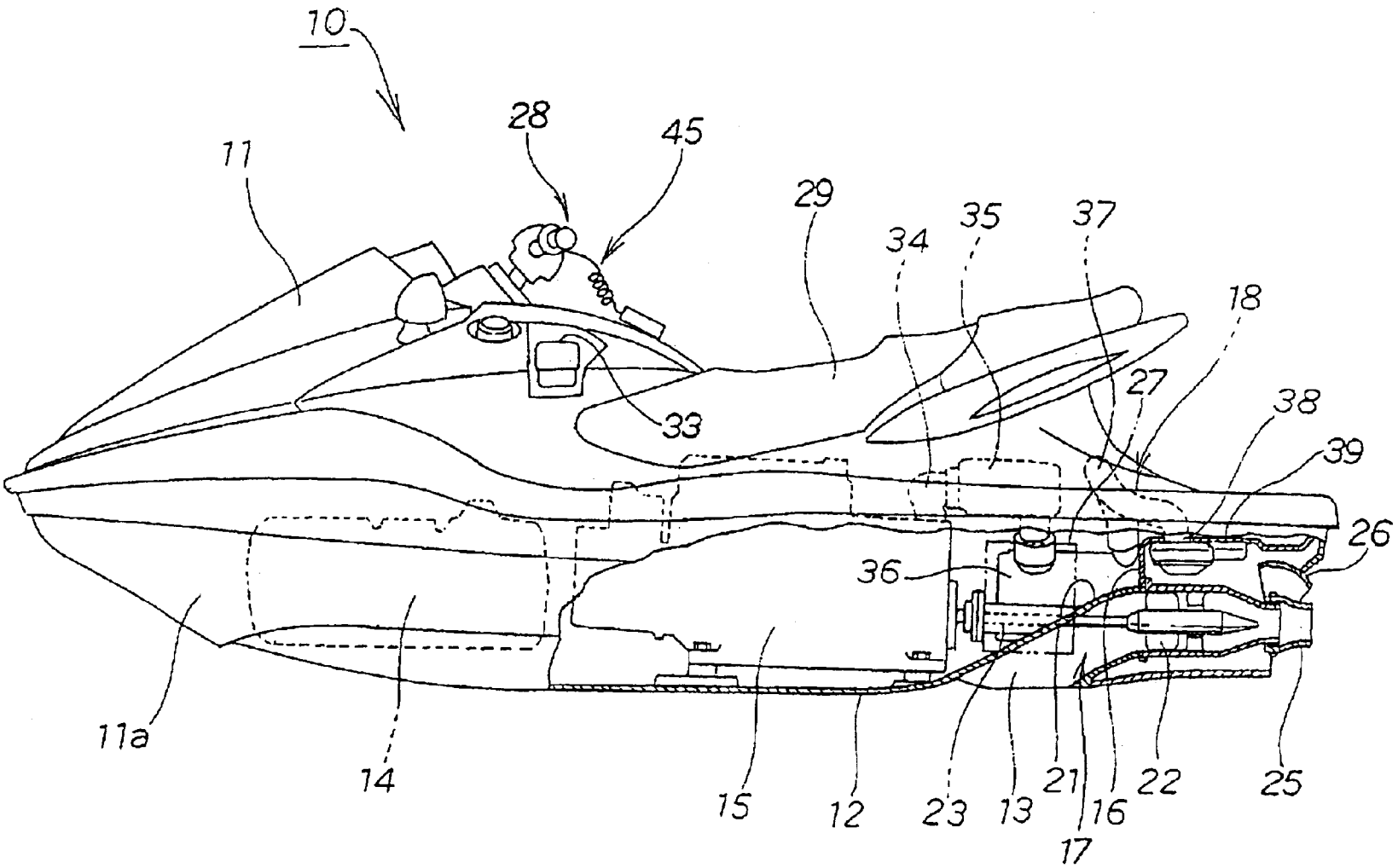
FIG. 1 is a side view showing a jet propulsion boat according to the invention.

FIG. 1 is a side view showing a jet propulsion boat according to the present invention. The jet propulsion boat 10 includes a fuel tank 14 attached to the front 11*a* of a hull 11. An engine 15 is provided at the back of the fuel tank 14. A pump room 16 provided at the back of the engine 15 with a jet propulsion unit 17 provided in the pump room 16. An exhaust unit 18 is provided with an intake side being attached to the engine 15 and the exhaust side being attached to the pump room 16. A steering system 28 is attached over the fuel tank 14 and a seat 29 attached at the back of the steering system 28.

The jet propulsion unit 17 is provided with a housing 21 extending backwards from an opening 13 of the bottom 12 of the boat. An impeller 22 is attached in the housing 21 so that the impeller can be turned and is coupled to a driving shaft 23 of the engine 15.

According to the jet propulsion unit 17, water sucked via the opening 13 at the bottom 12 of the boat can be jetted at the back of the body 11 from a steering nozzle 25 via an opening at the rear end of the housing 21 by driving the engine 15 and revolving the impeller 22.

The steering nozzle 25 is a member attached to the rear end of the housing 21 so that the steering nozzle can be swung horizontally and is a nozzle for steering that controls a direction in which the body 11 is steered by swinging the nozzle horizontally by the operation of the steering system 28.

According to the jet propulsion boat 10, water is sucked via the opening 13 at the bottom 12 of the boat by supplying fuel from the fuel tank 14 to the engine 15, driving the engine 15, transmitting the driving force of the engine 15 to the impeller 22 via the driving shaft 23 and revolving the impeller 22. The sucked water is jetted from the steering nozzle 25 via the rear end of the housing 21 thus propelling the boat.

As described later, the jet propulsion boat 10 is a boat provided with a controller that executes an engine output control for gradually increasing the output of the engine as predetermined.

As illustrated in FIG. 1, a reverse bucket 26 is provided for covering the steering nozzle 25 when the boat is backed up and making a jet stream flow forward diagonally downward. An operating knob 33 is provided for operating the reverse bucket 26. An exhaust pipe 34, an exhaust body 35 and a battery 27 are provided within the body 11. A water muffler 36, a water rock pipe 37, a tail pipe 38 and a resonator 39 are mounted adjacent to the rear of the body 11.

Figure 2:
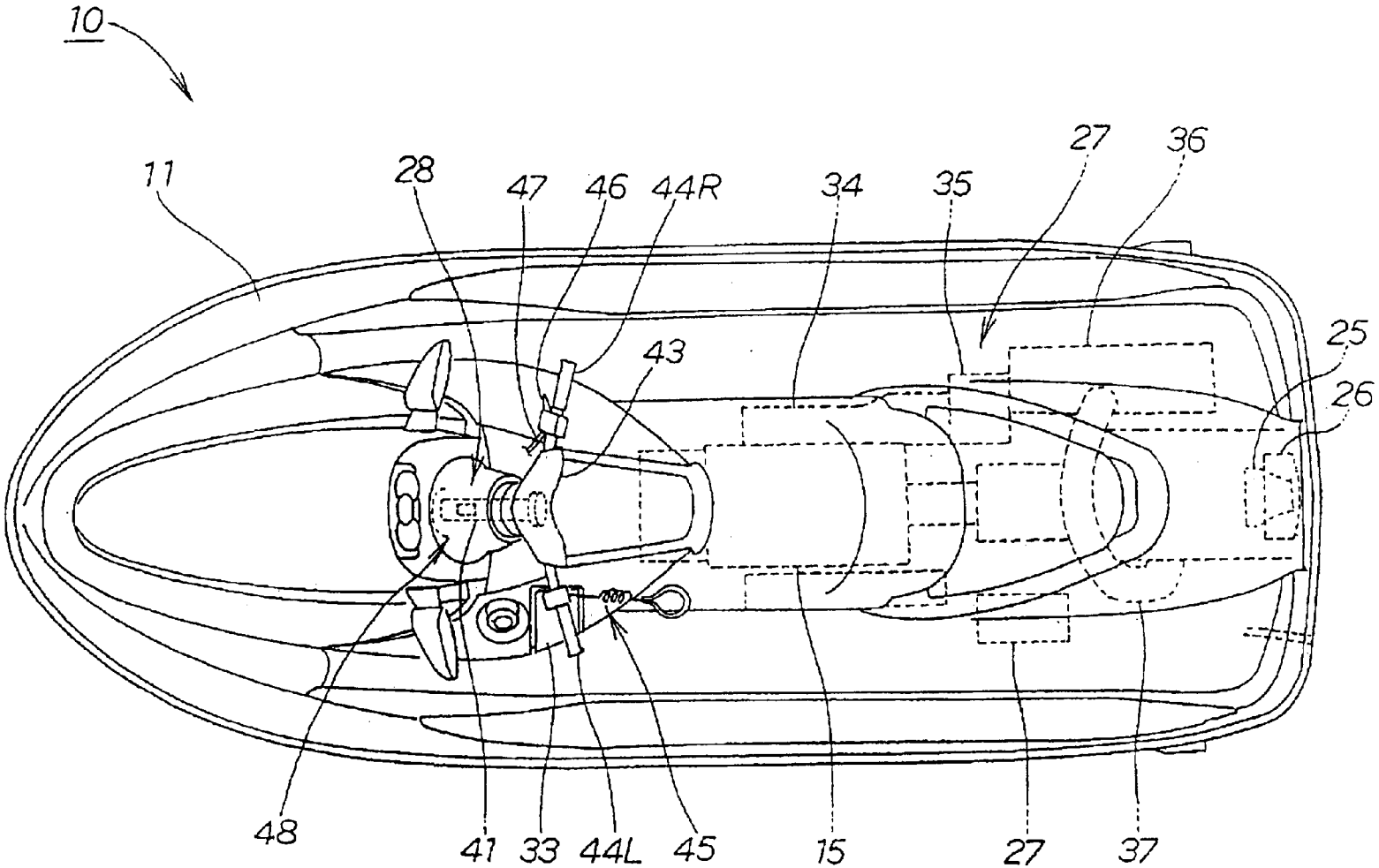
FIG. 2 is a plan showing the jet propulsion boat according to the invention.

FIG. 2 is a plan showing the jet propulsion boat according to the present invention. The steering system 28 includes a steering shaft 41 attached to the body so that the steering shaft can be rotated with a handlebar 43 attached to the upper end of the steering shaft 41. Right and left handle grips 44R and 44L are attached to the right end and the left end of the handlebar 43. A main switch 45 is provided with a lanyard switch provided at the base of the left handle grip 44L. A throttle lever 46 is attached at the base of the right handle grip 44R so that the throttle lever can be swung. A throttle cable 47 is provided that extends from the throttle lever 46 to a throttle and a steering detection mechanism 48 is provided at the lower end of the steering shaft 41.

Figure 3:
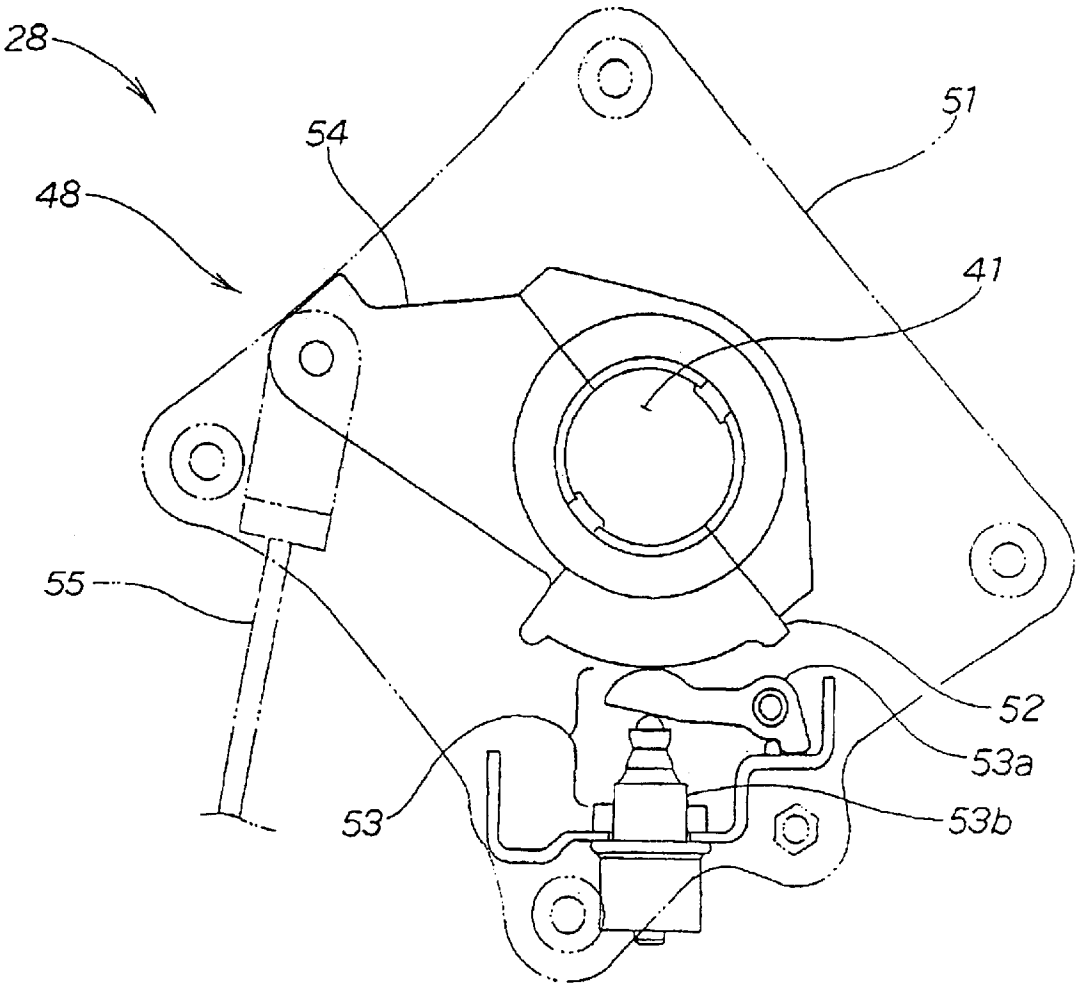
FIG. 3 is a plan showing a steering mechanism of the jet propulsion boat according to the invention.

FIG. 3 is a plan showing a steering mechanism of the jet propulsion boat according to the present invention. The steering detection mechanism 48 includes a bracket 51 attached to the body 11, as shown in FIG. 1. A switch cam 52 is attached to the lower end of the steering shaft 41. A steering switch 53 for turning on or off the switch cam 52 and a cam plate 54 is attached to the lower end of the steering shaft 41. A driving link 55 is provided for driving the steering nozzle 25 shown in FIG. 1 by being attached to the end of the cam plate 54 so that the driving link can be rotated. A switch lever 53*a* of the steering switch 53 and 53*b* denotes the body of the steering switch 53.

Figure 4:
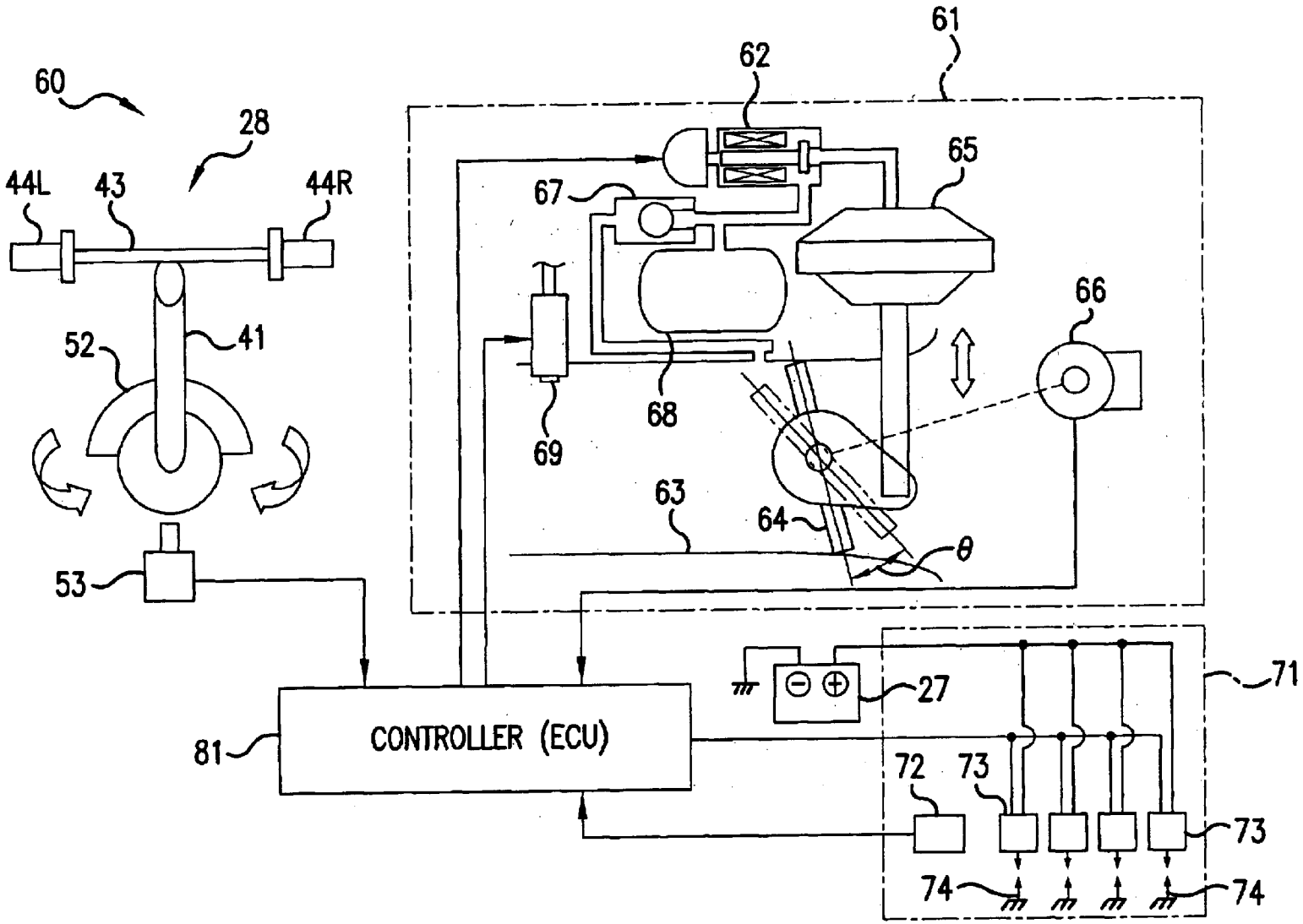
FIG. 4 is a block diagram showing an OTS controller of the jet propulsion boat according to the invention.

FIG. 4 is a block diagram showing an OTS controller of the jet propulsion boat according to the present invention. OTS is an abbreviation of an off throttle steering system and the OTS controller 60 of the jet propulsion boat is a system composed of the steering system 28 for steering the body 11 shown in FIG. 1, a fuel injection system 61 for supplying fuel to the engine 15 shown in FIG. 1, an igniter 71 for igniting fuel jetted from the fuel injection system 61 and a controller (ECU) 81 for controlling a system related to the engine 15 including the fuel injection system 61 and the igniter 71. The OTS controller 60 is also a system for executing engine output control for gradually increasing the output of the engine 15 to a predetermined output to increase the output of the engine 15 when the throttle 64 is closed while the body 11 is navigated at a predetermined speed or higher speed and the steering system 28 is steered right or left at a predetermined angle or a larger angle.

The fuel injection system 61 includes a solenoid 62 for controlling negative pressure according to information from the controller (ECU) 81, a throttle 64 for adjusting the amount of air-fuel mixture supplied to the engine 15 shown in FIG. 1 by providing the throttle to an intake passage 63, a diaphragm 65 for adjusting a throttle angle by providing the diaphragm between the solenoid 62 and the throttle 64, a throttle sensor 66 for detecting a throttle angle, a one-way valve 67 for preventing the back flow of negative pressure and preventing pressurization from penetrating by providing the one-way valve between the solenoid 62 and the intake passage 63. A surge tank 68 is provided for reducing the variation of negative pressure by providing the surge tank between the one-way valve 67 and the solenoid 62. An injector 69 is provided for turning fuel into minute spray and supplying it to the intake passage 63. As illustrated in FIG. 4, a throttle angle θ is provided.

The igniter 71 is composed of a crank angle sensor 72 for detecting a crank angle to set ignition timing. Ignition coils 73 are provided for every cylinder of the engine 15 shown in FIG. 1 to generate a high voltage according to an instruction from the controller (ECU) 81. Spark plugs 74 are provided for generating sparks by voltage applied from the ignition coils 73.

Figure 5:
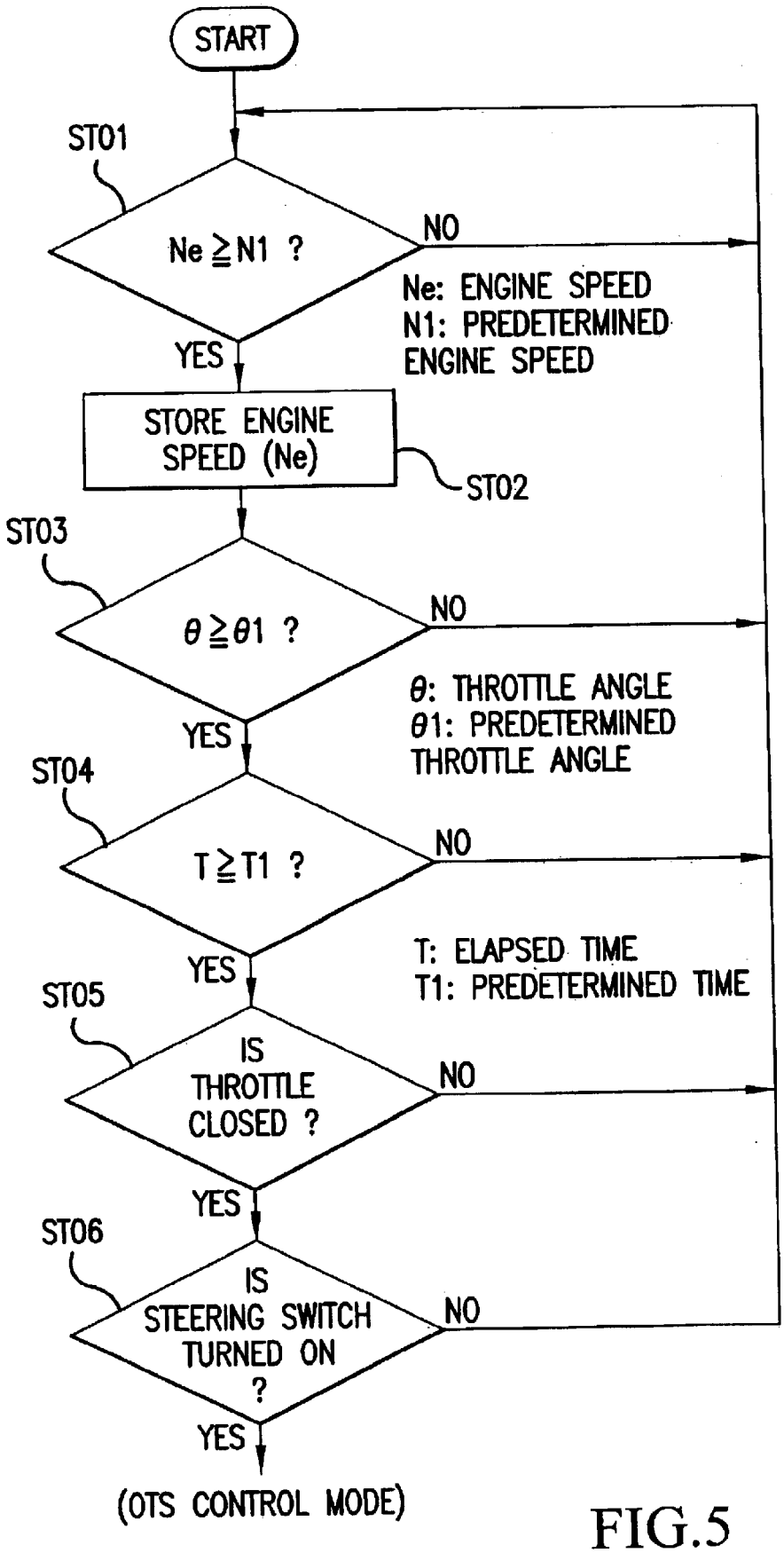
FIG. 5 is a flowchart showing an OTS control condition of the jet propulsion boat according to the invention.

FIG. 5 is a flowchart showing an OTS control condition of the jet propulsion boat according to the present invention. "ST" denotes a step.

ST01: When an engine speed is Ne and the predetermined engine speed (hereinafter called predetermined speed N1) is N1, it is judged whether engine speed Ne is equal to or exceeds the predetermined speed N1 (Ne≧N1) or not. That is, control is executed under the consideration that the output of the engine is engine speed Ne. If the answer is YES, the process proceeds to ST02 and if the answer is NO, control is returned to start.

ST02: The current engine speed Ne is stored in the controller (ECU) 81. The speed of the boat is calculated based upon the engine speed Ne, however, the reason is that control modes are different in a case that the current speed of the boat exceeds the predetermined speed of the boat and a case wherein the current speed is slower than the predetermined speed as described later.

ST03: When a throttle angle is θ and a predetermined throttle angle (hereinafter called a predetermined angle θ1) is θ1, it is judged whether the current throttle angle θ exceeds the predetermined angle θ1 or not. If the answer is YES, the process proceeds to ST04 and if the answer is NO, control is returned to ST01.

ST04: When time is T and the predetermined time is T1, it is judged whether a state exists wherein the current engine speed is equal to or exceeds the predetermined speed N1 and a state wherein the current throttle angle is equal to or exceeds the predetermined angle θ1 with both continuing for the predetermined time T1 or more or not. If the answer is YES, the process proceeds to ST05 and if the answer is NO, control is returned to ST01.

ST05: It is judged whether the throttle 64 is closed (a throttle angle θ=0) or not. If an answer is YES, the process proceeds to ST05 and if the answer is NO, control is returned to ST01.

It is judged whether the steering switch 53 is turned on or not. If the answer is YES, the process proceeds to OTS Control Mode. That is, as it is all met that engine speed Ne exceeds the predetermined speed N1, which is a control condition of OTS, a throttle angle θ exceeds the predetermined throttle angle θ1, in a state wherein the engine speed is equal to or exceeds the predetermined speed N1 and in a state wherein the throttle angle is equal to or exceeds the predetermined angle θ1 with both continuing for the predetermined time T1 or more, the throttle 64 is closed and the steering switch 53 is turned on, the current mode is turned into an OTS control mode. If the answer is NO, control is returned to ST01.

Figures 6A, 6B, 6C, 6D:
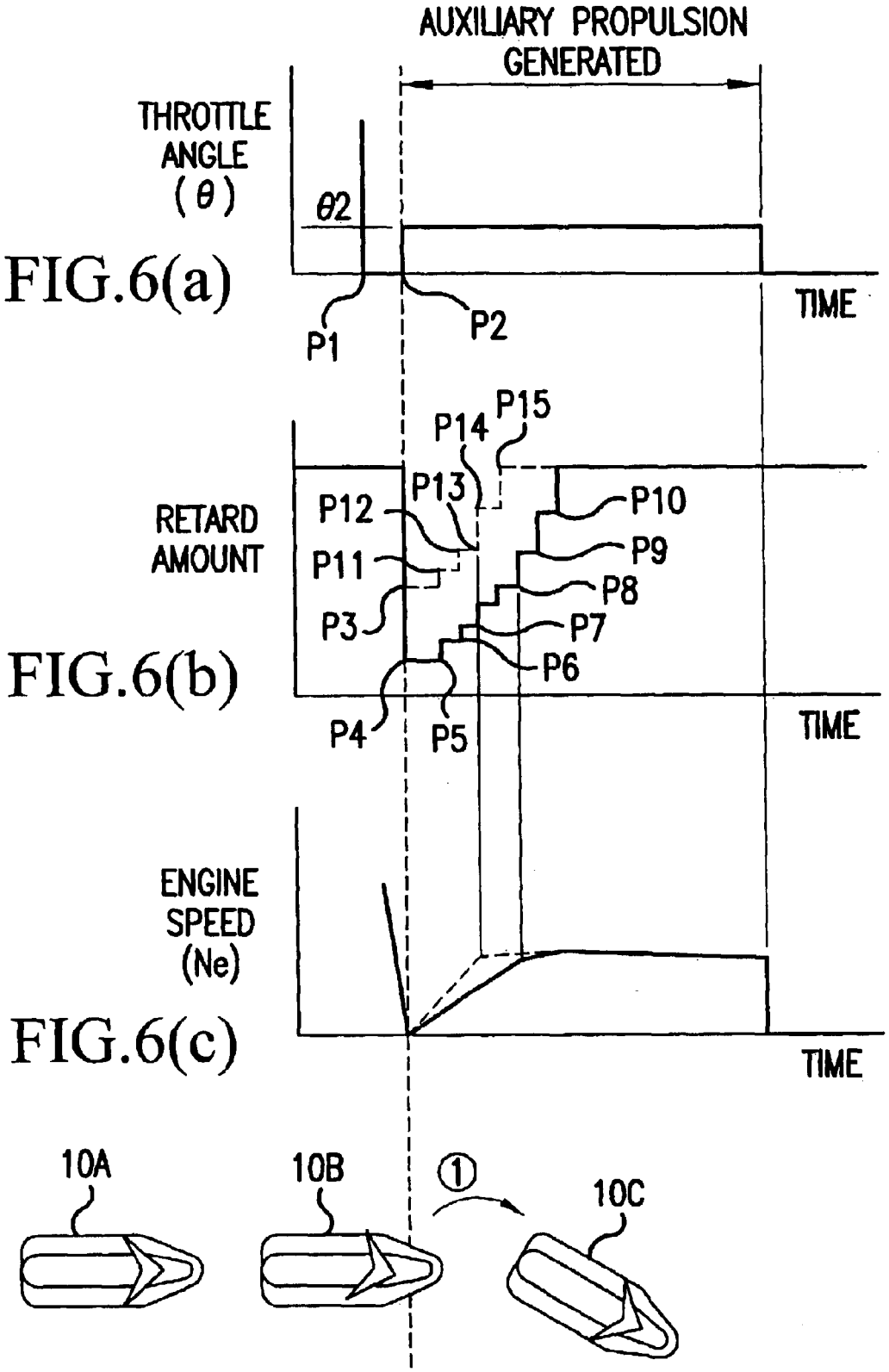
FIGS. 6(*a*) to 6(*d*) are explanatory drawings for explaining an OTS control mode of the jet propulsion boat according to the invention.
Figures 7A, 7B, 7C:
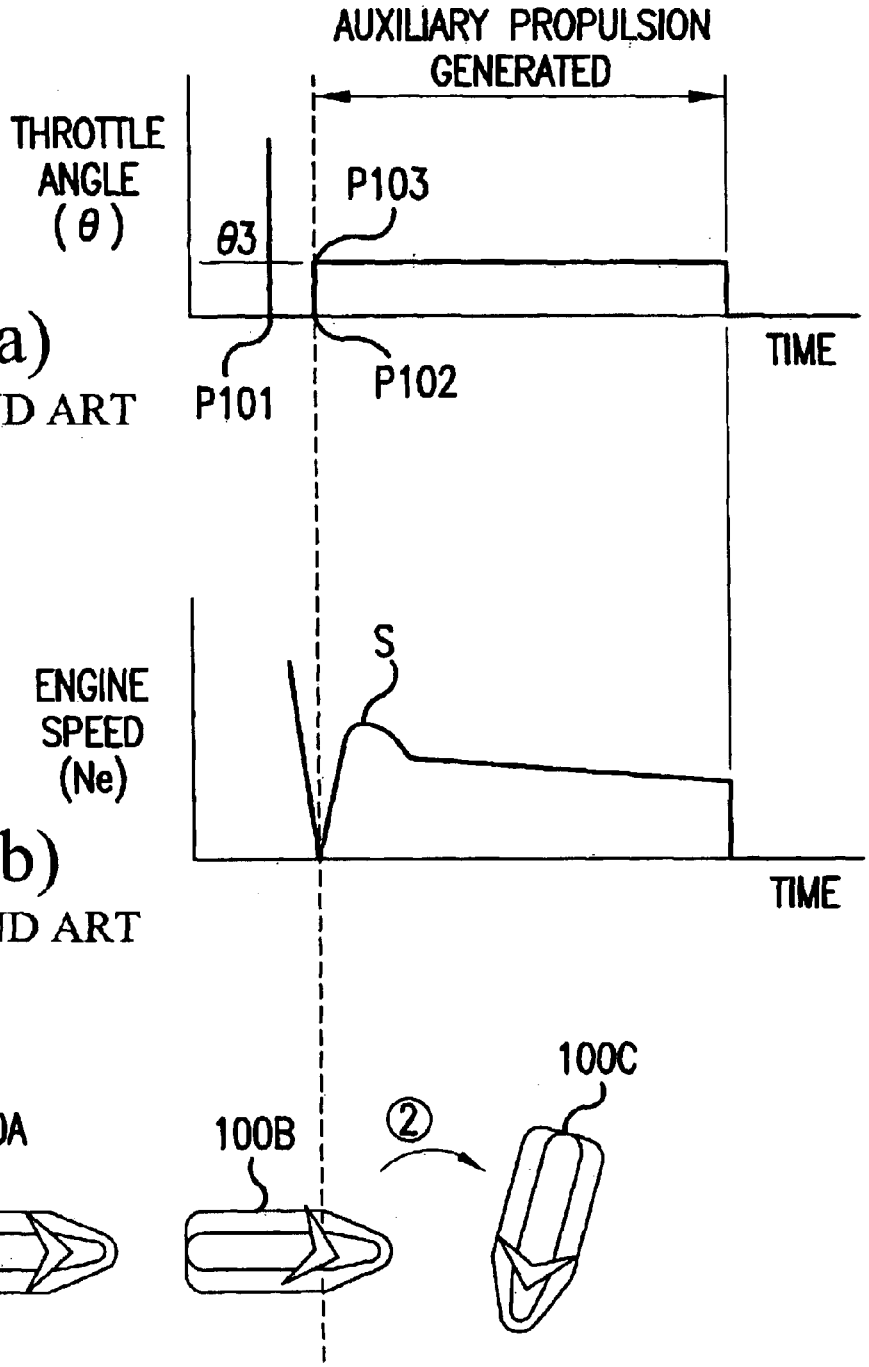
FIG.7(a) BACKGROUND ART
FIG.7(b) BACKGROUND ART
FIG.7(c) BACKGROUND ART
FIGS. 7(*a*) to 7(*c*) are explanatory drawings showing an improved jet propulsion boat.

Referring to FIGS. 6(*a*) to 6(*c*), the OTS control mode will be described below.

FIGS. 6(*a*) to 6(*c*) are explanatory drawings for explaining the OTS control mode of the jet propulsion boat according to the invention and the flow will be described below.

FIG. 6(*a*) is a graph showing a throttle angle in the OTS control mode, the y-axis shows a throttle angle θ and the x-axis shows time. FIG. 6(*b*) is a graph showing a retard amount and a revertive state in the retard amount respectively in the OTS control mode, FIG. 6(*c*) is a graph showing engine speed in the OTS control mode, the y-axis shows engine speed Ne and the x-axis shows time.

As shown in FIG. 6(*a*), the throttle 64 is turned off for a predetermined time (between P1 and P2). Next, when an angle of the throttle 64 in the OTS control mode is an OTS set angle θ2, a throttle angle θ at P2 is set to θ2.

As shown in FIG. 6(*b*), in the OTS control mode, the ignition timing of the engine 15 is adjusted to control the engine speed (the output) of the engine 15 shown in FIG. 1. That is, a method of reducing the engine speed of the engine 15 by retarding the ignition timing of the engine 15 is used.

A retard amount (a lag) is defined as an angle acquired by retarding a crank angle of the ignition timing of the engine 15 set in normal navigation by a predetermined angle.

In the case where the boat is navigated at a low speed, a value shown as a retard amount for low speed P4 is set and in case the boat is navigated at high speed, a value shown as a retard amount for high speed P3 is set.

In the case where the boat is navigated at a low speed, the turning performance of the body 11 is secured by slowing a jet stream is selected. Therefore, the retard amount for low speed P4 as a large retard amount is selected.

In the meantime, in the case where the boat is navigated at a high speed, the turning performance of the body 11 shown in FIG. 1 is secured by quickening a jet stream. Therefore, the retard amount for high speed P3 as a small retard amount is selected.

In the case where the retard amount for a low speed is selected (in case the engine speed is stored in ST02 shown in FIG. 5 is the predetermined speed or less), the retard amount for a low speed P3 is held for a predetermined time (between P4 and P5).

After the predetermined time (between P4 and P5) elapses, restoration is started in a first step for low speed between P5 and P6 and between P6 and P7, from an intermediate point of the retard amount for a low speed shown by P8, restoration is made in a second step for a low speed between P8 and P9 and between P9 and P10 and the original ignition timing is restored. For example, in the case where the retard amount for a low speed is 15°, the crank angle is restored by 1° at a time in the first step for low speed and is restored by 2° at a time in the second step for low speed.

In the case where the retard amount for high speed is selected (in case the engine speed stored in ST02 shown in FIG. 5 exceeds the predetermined speed), the retard amount for high speed P3 is held for a predetermined time (between P4 and P5).

After a predetermined time (between P3 and P11) elapses, restoration is started in a first step for a high speed between P11 and P12 and between P12 and P13, from an intermediate point of the retard amount for the high speed shown by P13, restoration is made in a second step for high speed between P13 and P14 and between P14 and P15 and the original ignition timing is restored. For example, in the case where the retard amount for high speed is 10°, the crank angle is restored by 1° at a time in the first step for high speed and is restored by 2° at a time in the second step for high speed.

FIG. 6(*c*) shows that engine output control according to the speed of the boat which is enabled by selecting the retard amount for high speed P3 or the retard amount for low speed P4 respectively shown in FIG. 6(*b*).

The turning performance of the body 11 shown in FIG. 1 can be precisely controlled by enabling selection of the retard amount for high speed P3 or the retard amount for low speed P4 and selecting the retard amount.

As shown in FIG. 6(*d*), the control wherein the jet propulsion boat 10A is navigated in a straight line and generates auxiliary propulsion at the time of the jet propulsion boat 10B and the engine speed is gradually increased. The jet propulsion boat 10C can be turned in a desired course shown by an arrow 1.

That is, it can be said that the jet propulsion boat 10 shown in FIG. 1 is of a type wherein the impeller 22 is turned by the engine 15 as a driving source with a jet stream being generated by the impeller 22. The body 11 is advanced by jetting the jet stream via the nozzle (the steering nozzle 25) and the direction of the nozzle (the steering nozzle 25) is changed by the steering system 28 when the body 11 is turned right or left. The steering nozzle 25 is provided with the controller 81 shown in FIG. 4 which executes engine output control wherein the throttle 64 shown in FIG. 4 is closed when the boat is navigated at a predetermined speed or higher and the output of the engine 15 is gradually increased up to a predetermined output when the steering system 28 is steered right or left at a predetermined angle or more.

When the throttle 64 is closed and the steering system 28 shown in FIG. 4 is steered to avoid an obstacle which emerges in front of the body 11 shown in FIG. 1, turning performance is deteriorated because the amount of a jet stream decreases. Then, the output of the engine is increased up to a predetermined output and the amount of the jet stream is increased under a fixed condition.

However, when the throttle 64 is closed for navigation at minute speed such as entering a port and the output of the engine is reduced, the engine speed Ne of the engine 15 shown in FIG. 1 is not required to be increased. As turning performance is in question, the output of the engine is not required to be increased when the steering system 28 is not steered.

Therefore, it is a prerequisite that the throttle 64 is closed when the boat is navigated at a predetermined speed or higher and the steering system 28 is steered right or left at a predetermined angle or more.

When the body 11 shown in FIG. 1 is propelled, pressure in front of the impeller 22 shown in FIG. 1 is lower than pressure at the back and when the body 11 is decelerated, pressure in front of the impeller 22 is higher than pressure at the back. Therefore, when the engine speed is increased to enhance the output of the engine during deceleration, an overshoot phenomenon wherein the engine speed is held at a predetermined speed after the engine speed once increases at the predetermined speed or higher occurs and the body 11 may slide laterally to a great extent. Then, the controller 81 shown in FIG. 4 is provided that executes an engine control for gradually increasing the output of the engine up to predetermined output. As a result, the body 11 shown in FIG. 1 can be prevented from sliding laterally to a great extent at the beginning of the turning and the turning performance of the body 11 can be enhanced.

The jet propulsion boat 10 shown in FIG. 1 enables selecting a retard amount for a low speed or a retard amount for a high speed depending upon the speed of the boat. The controller 81 is provided with plural engine output control characteristics and the output control of the engine 15 shown in FIG. 1 is executed by selection depending upon the speed of the boat.

The engine output control characteristic matched with the speed of the boat can be used by providing the plural engine output control characteristics to the controller 81 and enabling selection depending upon the speed of the boat. As a result, the turning performance of the body can be further enhanced.

In this embodiment, the retard amount for high speed and the retard amount for low speed are set as shown in FIGS. 6(*a*) to 6(*c*), a retard amount is not limited to these, a retard amount for intermediate speed is set and the selection of three or more modes may also be enabled.

In this embodiment, as shown in FIGS. 6(*a*) to 6(*c*), the retard amount for high speed is set at 10°, the retard amount for low speed is set at 15°, the retard amount for high speed is restored by 1° at a time at first, then by 2° at a time, similarly, the retard amount for low speed is restored by 1° at a time at first, then by 2° at a time. However, the above is one example, and the amount and the frequency may arbitrarily be set depending upon specifications of the jet propulsion boat. A point at which a first high speed step is changed to a second high speed step is also arbitrary and a point at which a first low speed step is changed to a second low speed step is also arbitrary.

Further, in this embodiment, as shown in FIGS. 6(*a*) to 6(*c*), the speed of the engine 15 shown in FIG. 1 is controlled by varying only the ignition timing. However, the present invention is not limited to this, the engine speed may be also changed by increasing or decreasing injection quantity and may be also controlled by the combination of the variation of the ignition timing and the increase or decrease of the injection quantity. That is, engine output control that a throttle is closed when a boat is navigated at a predetermined speed or higher and that the output of an engine is gradually increased up to predetermined output when a steering system is steered right or left at a predetermined angle or more has only to be executed.

The invention produces the following effect based upon the configuration described above.

According to the present invention, as the controller that executes engine output control that the throttle is closed when the boat is navigated at a predetermined speed or higher and the output of the engine is gradually increased up to a predetermined output when the steering system is steered right or left at a predetermined angle or more is provided, the overshoot phenomenon that the engine speed is held at a predetermined speed after the engine speed once increases at the predetermined speed or higher when the engine speed is increased in deceleration can be avoided. As a result, the body of the boat can be prevented from sliding laterally to a great extent at the beginning of turning and the turning performance of the body can be enhanced.

According to the present invention, as the controller is provided with the plural engine output control characteristics and engine output control is executed by selection depending upon the speed of the boat, the engine output control characteristic matched with the speed of the boat can be used. As a result, the turning performance of the body can be further enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A jet propulsion boat wherein an impeller is turned by an engine as a driving source, a jet stream is generated by the impeller, the boat is advanced by jetting the jet stream via a nozzle and the direction of the nozzle is changed by a steering system when the boat is turned right or left, comprising:

a controller for executing engine output control when a throttle is closed in navigation at a predetermined speed or higher for gradually increasing the output of the engine up to a predetermined output when a steering handlebar is steered right or left at a predetermined angle or more, wherein the controller for executing the engine output control incrementally increases a crank angle of an ignition timing at a first rate during a first time period, and then incrementally increases the crank angle of the ignition timing at a second rate at for at least second time period, the second rate of increase of the crank angle being greater than the first rate of increase of the crank angle.

2. The jet propulsion boat according to claim 1, wherein the controller is provided with plural engine output control characteristics and the engine output control is executed by selection according to the speed of the boat.

3. The jet propulsion boat according to claim 1, wherein said controller includes a fuel injection system having a solenoid for controlling negative pressure responsive to a signal provided from the controller and a diaphragm operatively positioned relative to said solenoid and said throttle for adjusting said throttle.

4. The jet propulsion boat according to claim 3, and further including a throttle sensor for detecting a throttle angle and a one-way valve for preventing back flow of negative pressure and for preventing pressurization from penetrating by positioning the one-way valve between the solenoid and an intake passage.

5. The jet propulsion boat according to claim 4, and further including a surge tank being operatively connected between said one-way valve and the solenoid for reducing the variation of negative pressure.

6. The jet propulsion boat according to claim 1, wherein the speed of the boat is measured over a predetermined period of time when the throttle is closed prior to activating the controller for gradually increasing the output of the engine.

7. The jet propulsion boat according to claim 1, wherein the throttle angle is measured at or above a predetermined throttle angle for a predetermined period of time prior to activating the controller for gradually increasing the output of the engine.

8. A propulsion control system for use with a jet propulsion boat having an impeller for generating a jet stream wherein the boat is advanced by jetting the jet stream via a nozzle and the direction of the nozzle is changed by a steering system when the boat is turned right or left, comprising:

a controller for executing engine output control when a throttle is closed during navigation at a predetermined speed or higher for gradually increasing the output of an engine up to a predetermined output when a steering handlebar is steered right or left at a predetermined angle or more, wherein the controller for executing the engine output control incrementally increases a crank angle of an ignition timing at a first rate during a first time period, and then incrementally increases the crank angle of the ignition timing at a second rate at for at least second time period, the second rate of increase of the crank angle being greater than the first rate of increase of the crank angle.

9. The propulsion control system according to claim 8, wherein the controller is provided with plural engine output control characteristics and the engine output control is executed by selection according to the speed of the boat.

10. The propulsion control system according to claim 8, wherein said controller includes a fuel injection system having a solenoid for controlling negative pressure responsive to a signal provided from the controller and a diaphragm operatively positioned relative to said solenoid and said throttle for adjusting said throttle.

11. The propulsion control system according to claim 10, and further including a throttle sensor for detecting a throttle angle and a one-way valve for preventing back flow of negative pressure and for preventing pressurization from penetrating by positioning the one-way valve between the solenoid and an intake passage.

12. The propulsion control system according to claim 11, and further including a surge tank being operatively connected between said one-way valve and the solenoid for reducing the variation of negative pressure.

13. The propulsion control system according to claim 8, wherein the speed of the boat is measured over a predetermined period of time when the throttle is closed prior to activating the controller for gradually increasing the output of the engine.

14. The propulsion control system according to claim 8, wherein the throttle angle is measured at or above a predetermined throttle angle for a predetermined period of time prior to activating the controller for gradually increasing the output of the engine.

15. The jet propulsion boat according to claim 1, wherein a point at which the first time period ends and the second time period begins is artibrary.

16. The jet propulsion boat according to claim 1, wherein the controller for executing the engine output control retards the crank angle of the ignition timing by a predetermined retard amount which varies depending on a cruising speed of the boat, the predetermined retard amount being higher at a low cruising speed of the boat than the predetermined retard amount at a high cruising speed of the boat.

17. The jet propulsion boat according to claim 16, wherein the controller for executing the engine output control incrementally increases the crank angle of the ignition timing after the crank angle of the ignition timing has been retarded by the predetermined amount.

18. The propulsion control system according to claim 8, wherein a point at which the first time period ends and the second time period begins is arbitrary.

19. The propulsion control system according to claim 8, wherein the controller for executing the engine output control retards the crank angle of the ignition timing by a predetermined retard amount which varies depending on a cruising speed of the boat, the predetermined retard amount being higher at a low cruising speed of the boat than the predetermined retard amount at a high cruising speed of the boat.

20. The propulsion control system according to claim 19, wherein the controller for executing the engine output control incrementally increases the crank angle of the ignition timing after the crank angle of the ignition timing has been retarded by the predetermined amount.

* * * * *